US010047942B2

(12) United States Patent
Liu et al.

(10) Patent No.: US 10,047,942 B2
(45) Date of Patent: Aug. 14, 2018

(54) CONNECTOR DEVICE AND ILLUMINATION APPARATUS COMPRISING THE CONNECTOR DEVICE

(71) Applicant: OSRAM GmbH, München (DE)

(72) Inventors: Jun Liu, Shenzhen (CN); Shijun Nie, Shenzhen (CN)

(73) Assignee: LEDVANCE GmbH, Garching (DE)

( * ) Notice: Subject to any disclaimer, the term of this patent is extended or adjusted under 35 U.S.C. 154(b) by 49 days.

(21) Appl. No.: 15/312,513

(22) PCT Filed: Feb. 4, 2015

(86) PCT No.: PCT/EP2015/052275

§ 371 (c)(1),
(2) Date: Nov. 18, 2016

(87) PCT Pub. No.: WO2015/176828

PCT Pub. Date: Nov. 26, 2015

(65) Prior Publication Data

US 2017/0089558 A1 Mar. 30, 2017

(30) Foreign Application Priority Data

May 19, 2014 (CN) ..... 2014 1 0211549

(51) Int. Cl.
*F21V 23/06* (2006.01)
*H01R 35/04* (2006.01)
*F21V 14/02* (2006.01)

(52) U.S. Cl.
CPC ..... *F21V 23/06* (2013.01); *F21V 14/02* (2013.01); *H01R 35/04* (2013.01)

(58) Field of Classification Search
None
See application file for complete search history.

(56) References Cited

U.S. PATENT DOCUMENTS

2010/0219739 A1 9/2010 Kuo et al.
2013/0107537 A1 5/2013 Lee et al.

FOREIGN PATENT DOCUMENTS

EP 1672277 A1 6/2006
EP 2354650 A2 8/2011
(Continued)

OTHER PUBLICATIONS

International Search Report and Written Opinion issued in International Application No. PCT/EP2015/052275, dated May 8, 2015 (10 pages).

*Primary Examiner* — Britt D Hanley
(74) *Attorney, Agent, or Firm* — Hayes Soloway PC

(57) ABSTRACT

The present invention relates to a connector device for an illumination apparatus and an illumination apparatus comprising this connector device. The connector device comprises a stationary element for connecting to the illumination apparatus, a first movable element for connecting to a power supply, a second movable element rotatably connected to the stationary element, and a locking element arranged between the stationary element and the second movable element, wherein rotation of the second movable element in a first direction drives the locking element to release locking of the second movable element, and when the second movable element continues to be rotated in the first direction and drives the first movable element to rotate together, rotation of the first movable element enables the locking element to release locking of the first movable element.

17 Claims, 4 Drawing Sheets

(56) References Cited

FOREIGN PATENT DOCUMENTS

| | | | |
|---|---|---|---|
| EP | 2602542 | A1 | 6/2013 |
| JP | 2011070985 | A | 4/2011 |
| WO | 2013034525 | A1 | 3/2013 |

CONNECTOR DEVICE AND ILLUMINATION APPARATUS COMPRISING THE CONNECTOR DEVICE

CROSS-REFERENCE TO RELATED APPLICATIONS

This application is the U.S. national phase entry under 35 U.S.C. § 371 of International Application No. PCT/EP2015/052275, filed on Feb. 4, 2015, which claims priority to Chinese Patent Application No. 201410211549.5, filed on May 19, 2014, the entirety of which are incorporated by reference herein.

TECHNICAL FIELD

The present invention relates to a connector device for an illumination apparatus and an illumination apparatus comprising said connector device.

BACKGROUND ART

For a common illumination apparatus currently used, for instance, an illumination apparatus having a tubular light engine of a conventional light source, the light engine has to be electrically connected to a power supply via a connector device and has the location and illumination direction fixed thereby. However, after the currently known connector device is connected to the light engine, an illumination direction of the light engine cannot be adjusted, that is, the connection between the light engine and the connector device is mechanically fixed and cannot be changed, and it cannot achieve for instance the rotation of the light engine relative to the connector device to change the illumination direction of the light engine.

Besides, according to the designs of the currently known convector devices of other types, only after removing the connector device from the light engine, i.e., separating the connector device from the light engine, could the user adjust the illumination direction of the light engine, moreover, after the adjustment, the user should re-connect the light engine with the connector device. The above design of the connector device is quite unfavorable to the flexible use of the illumination apparatus, and the user cannot flexibly and conveniently adjust the light engine to make the illumination of the illumination apparatus adapted to particular application circumstances, such design limits the situations where the illumination apparatus can be applied, and the user has to look for a lamp holder matching the light engine to ensure that the light can illuminate in a correct direction. Such illumination apparatus is not friendly to the user.

SUMMARY OF THE INVENTION

In order to solve the above technical problems, the present invention provides a novel connector device and an illumination apparatus comprising said connector device. According to the connector apparatus of the present invention, the light engine can be flexibly and conveniently rotated relative to the connector device without removing the connector device from the light engine, so as to simply adjust an illumination direction of the illumination apparatus. Besides, the connector device according to the present invention has a simple structure and a low cost, and the user's operation to this device is simple and convenient, without complex operation process and instruction.

One object of the present invention is accomplished via a connector device, i.e., a connector device used for an illumination apparatus, comprising a stationary element for connecting to the illumination apparatus, a first movable element for connecting to a power supply, a second movable element rotatably connected to the stationary element, and a locking element arranged between the stationary element and the second movable element, characterized in that rotation of the second movable element in a first direction drives the locking element to release locking of the second movable element, and when the second movable element continues to be rotated in the first direction and drives the first movable element to rotate together, rotation of the first movable element enables the locking element to release locking of the first movable element. According to the solution of the present invention, prior to operation of a user to the second movable element, the connector device, with the locking element therein, can maintain the connection of the stationary element with the first and second movable elements. The user can achieve the rotation of the first moveable part just by rotating the second movable element, and such operation is extremely convenient and simple, without removing the movable element from the stationary element, thereby the user can quite simply achieve the rotation of the first movable element relative to the stationary element, when the first movable element is connected to the light engine, so as to adjust an illumination direction of the illumination apparatus According to a preferable embodiment of the present invention, at least one first drive structure and a second drive structure are arranged on a surface of the second movable element facing the stationary element, wherein the second movable element, with the interaction between the first drive structure and the locking element, enables the locking element to move and releases locking of the second movable element, and the second movable element, with the interaction between the second drive structure and the first movable element, drives the first movable element to rotate together.

With the aid of the first and second drive structures arranged on the second movable element, the second movable element can simply transmit a rotational force to the first movable element via a built-in, integrated part thereof, without other additional tools, when the second movable element is subject to rotational operation, so as to achieve indirect manipulation to the first movable element.

Preferably, the first drive structure, with an axial component force generated on the locking element when the second movable element is rotated, enables the locking element to move axially to release locking of the second movable element. A component of a force applied on the second movable element when the second movable element is rotated turns to be applied on the locking element, and the locking element subsequently can move along an axial direction of the locking element with the help of the component of the force. In this way, a displacement distance and range of the locking element needed for unlocking the second movable element can be reduced so as to render a more compact structure of the connector device having the locking element.

Preferably, the locking element locks the second movable element when the locking element is received in the first drive structure. Specifically, in a movement direction of the locking element, an end portion of the locking element can be received in the second movable element to lock the second movable element. According to this configuration, the locking element can move out of the second movable element, through the axial movement thereof, so as to unlock the second movable element.

Preferably, a driven structure, arranged on a surface of the first movable element facing the second movable element, is connected with the second drive structure in a form-fitted manner. Specifically, after the second movable element is rotated with a certain angle, the driven structure can be against in the second movable element and engaged in the second drive structure, in this way, a force applied on the second movable element can be transferred, via the driven structure, to the first movable element, so as to enable the first movable element to rotate with the second movable element through a simple design.

According to an embodiment of the present invention, when the second movable element is rotated in a second direction opposite to the first direction, rotation of the second movable element in the second direction is capable of restoring the locking of the first movable element and the second movable element by the locking element. In order to again achieve locking of the first and second movable elements after the rotational adjustment of the first movable element is finished, the locking element can be restored to a position where it is located before unlocking the first and second movable elements, by simply rotating the second movable element in an opposite direction, so as to achieve restoring of locking of the first and second movable elements.

According to an embodiment of the present invention, the first movable element comprises at least one third drive structure, when the second movable element continues to be rotated in the first direction and drives the first movable element to rotate together, the first movable element, with the interaction between the third drive structure and the locking element, enables the locking element to continue to move and release the locking of the first movable element with the locking element. In order to continue to unlock the first movable element after unlocking the second movable element so as to enable the first movable element to rotate, when the second movable element drives the first movable element to rotate together, the first movable element can use a drive structure arranged thereon, preferably integrally configured, i.e., a third drive structure, to allow the locking element to continue to move axially, and continued movement of the locking element can release locking of the first movable element. During the process of unlocking the first and second movable elements, the rotational direction of the first movable element is consistent, and the operating action are also continuous, thus providing simple and convenient unlocking actions.

Preferably, the third drive structure, with an axial component force generated on the locking element when the first movable element is rotated, enables the locking element to move axially to release locking of the first movable element. Thus, a displacement distance and range of the locking element needed for unlocking the first movable element can be reduced, continuity of acts for unlocking the first movable element after unlocking the second movable element is maintained, thus rendering a more compact structure of the convector device having the locking element, and simpler and more convenient operation action.

Advantageously for the present invention, the third drive structure is configured as bore structure, through which bore structure the locking element extends and is received in the first drive structure to lock the first movable element and the second movable element. The bore structure forms a continuous movement path and passage needed for the locking element to lock and unlock the first and second movable elements, rendering continuous and consistent unlocking action on the second movable element.

Advantageously, the bore structure is arranged at the edge of the first movable element at least along the circumference of the first movable element. The bore structure arranged at the edge could provide positional aligning the bore structure to the initial position of the locking element, and that the bore structure could still correspond to the position of the locking element during the rotation of the second movable element.

Preferably, the edge portion of the bore structure towards the stationary element is configured to be rounded. When the first movable element is driven by the second movable element to rotate together, resistance resulted from the interaction between the part of the end portion of the locking element in direct contact with the bore structure and the edge portion of the bore structure can be reduced as much as possible, such that a relatively small force is required for rotating the first movable element and the simplicity of the operation is improved.

Preferably, the first drive structure is configured as a first recess, and the second drive structure is configured as a second recess. The design of the recess simplifies both manufacture and machining of the second movable element and can provide effective interaction between the locking element and the first recess, and between the driven structure and the second recess.

According to a preferable design of the present invention, the first recess is configured in a hemispherical profile, and the second recess is configured in an elliptical profile. The hemispherical profile of the first recess provides a relatively small resistance of interaction between the end portion of the locking element and the first recess when the second movable element is rotated. Besides, the elliptical profile of the second recess provides that the driven structure on the first movable element can be adapted to the elliptical profile to move, when the second movable element is rotated, and subsequently be against and engaged in the second recess, such that the first movable element is driven by the second movable element.

According to a preferable embodiment of the present invention, the locking element is configured as a cylindrical structure having elastic resilience, and when the second movable element is rotated in a second direction opposite to the first direction, the locking element is capable of automatically restoring the locking of the first movable element and the second movable element with the resilience. The elastic locking element can automatically restore to a locking state from an unlocking state, without an additional tool or an external force, which improves the operation simplicity.

Advantageously, the locking element comprises a spring and a pin, when the second movable element is rotated in the second direction, the pin is capable of automatically restoring the locking of the first movable element and the second movable element with the spring. This simple structure design provides simple operation actions and results in a low cost of manufacturing this connector device.

Preferably, the end portion of the locking element capable of interacting with the first drive structure and the second drive structure is configured in a hemispherical shape. When the end portion of the locking element interacts with the first drive structure on the second movable element, and when the end portion of the locking element interacts with the third drive structure on the first movable element, the hemispherical end portion has a relatively small resistance with the hemispherical first recess, and a relatively small resistance with the rounded portion of the third drive structure.

The other object of the present invention is accomplished via an illumination apparatus which comprises the connector device as described above and a light engine. According to the illumination apparatus of the present invention, a user can simply and conveniently rotationally adjust the first movable element of the connector device so as to adjust the illumination direction of the light engine.

BRIEF DESCRIPTION OF THE DRAWINGS

The accompanying drawings constitute a part of the present Description and are used to provide further understanding of the present invention. Such accompanying drawings illustrate the embodiments of the present invention and are used to describe the principles of the present invention together with the Description. In the accompanying drawings the same components are represented by the same reference numbers. As shown in the drawings.

DETAILED DESCRIPTION OF THE EMBODIMENTS

Figure 1:
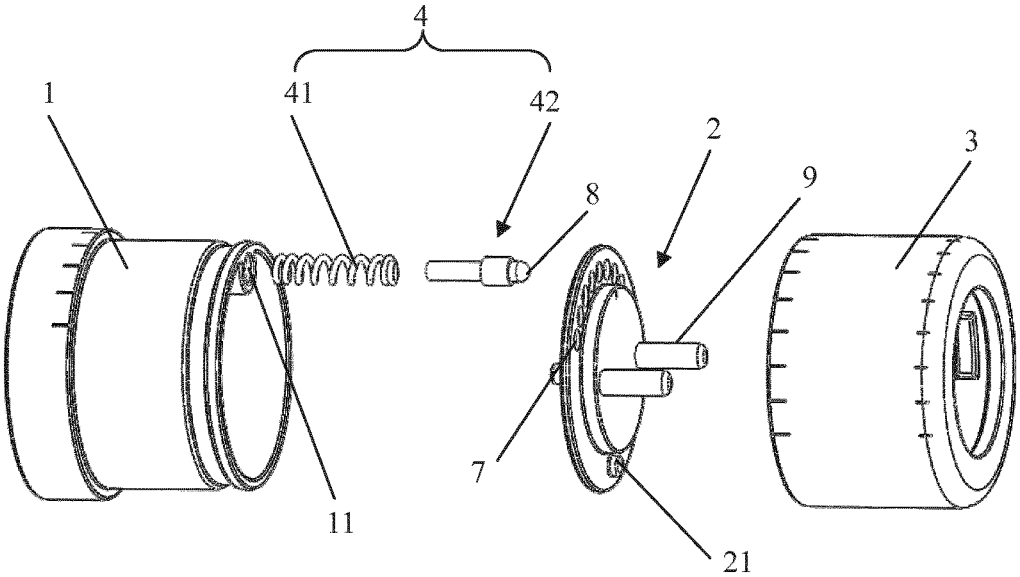
FIG. 1 shows an exploded diagram of a connector device according to an embodiment of the present invention.

FIG. 1 shows an exploded diagram of a connector device 100 according to an embodiment of the present invention. The connector device 100 according to the present invention comprises a stationary element 1 connected to a light engine of an illumination apparatus, a second movable element 3 capable of being sleeved on the stationary element 1 and partially enveloping the same, and a first movable element 2 arranged between the stationary element 1 and the second movable element 3. Furthermore, the connector device 100 also comprises a locking element 4 arranged inside the stationary element 1 and located between the stationary element 1 and the second movable element 3.

As shown in FIG. 1, a cavity 11 with a cylindrical profile can be preferably arranged on an inner wall of the stationary element 1. The cavity 11 extends along an axial direction of the stationary element 1 and is used to receive a spring 41 and a pin 42 included by the locking element 4. The pin 42 thereby can move along an axial direction of the pin 42 in the cavity 11. Herein, the pin 42 can be of a material preferably of metal or rigid plastic, and so designed pin 42 is wear-resistant and features such as insulation. A first drive structure and a second drive structure (not shown) are arranged on an inner surface of the second movable element 3, i.e., a surface facing the stationary element 1. Preferably, a plurality of bore structures is arranged on the edge of the first movable element 2. These bore structures can be preferably designed to distribute in half arc and form a third drive structure 7 in direct interaction with the pin 42. An end portion 8 of the pin 42 extend through the bore structures and is received in the first drive structure to form locking of the first movable element 2 and the second movable element 3 by the locking element 4. Besides, a driven structure 21, arranged on a surface of the first movable element 2, interacts with the above second drive structure such that the second movable element 3 can drive the first movable element 2 to rotate together. Electrical contact bodies 9 are further arranged on the first movable element 2 in order to provide an electric power to the light engine of the connector device 100.

Figure 2:
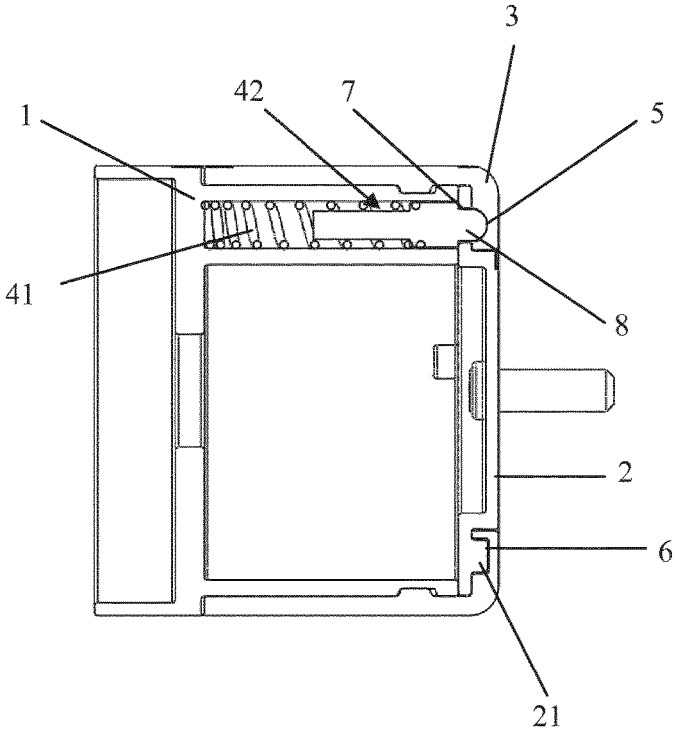
FIG. 2 shows a cross section schematic diagram in a state where a locking element of the connector device locks a first movable element and a second movable element according to an embodiment of the present invention.

FIG. 2 shows a cross-section schematic diagram in a state where the locking element 4 of the connector device 100 locks the first movable element 2 and the second movable element 3 according to an embodiment of the present invention. In FIG. 2, the locking element 4 is already in a state of locking the first movable element 2 and the second movable element 3. In this state, the end portion 8 of the pin 42, with a spring force of the spring 41, presses against and received in the first drive structure which is configured as first recess in a hemispherical shape, thereby forming the locking of the second movable element 3 by the locking element 4. Hereby, a main body of the end portion 8, by the spring force of the spring 41, also completely extends through the third drive structure 7 which is configured as bore structures, hence forming the locking of the first movable element 2 by the locking element 4.

Besides, in FIG. 2, the driven structure 21 on the first movable element 2 is received in the second drive structure 6 preferably for instance in a form-fitted manner. The second drive structure 6 is preferably configured as second recess having an elliptical profile. The driven structure 21 is preferably configured as protrusion having a cylindrical profile, hence, when the second movable element 3 is rotated, the protrusion can move in the second recess and then presses against one end of the second recess to be engaged in the second recess.

Figure 3:
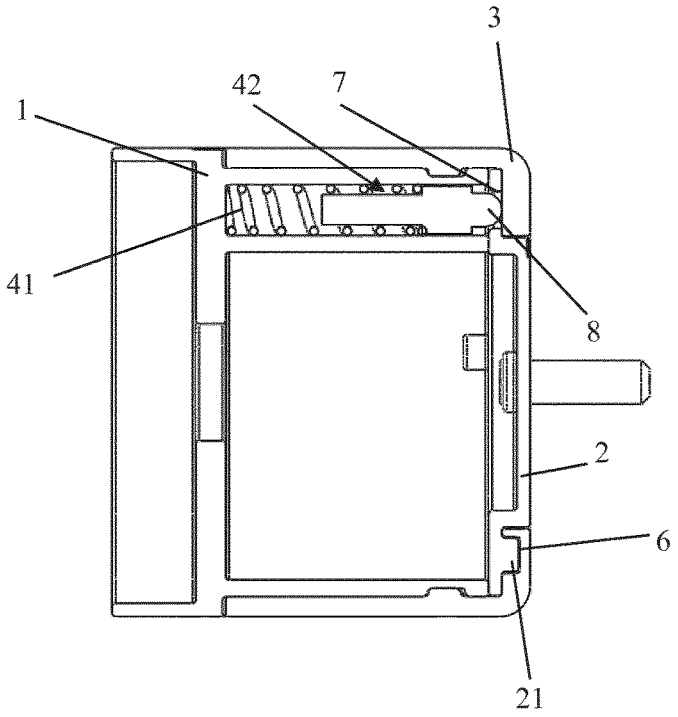
FIG. 3 shows a cross-section schematic diagram in a state where the locking element of the connector device unlocks the second movable element but still locks the first movable element according to an embodiment of the present invention.

FIG. 3 shows a cross-section schematic diagram in a state where the locking element 4 of the connector device 100 unlocks the second movable element 3 but still locks the first movable element 2 according to an embodiment of the present invention. When the second movable element 3 is rotated in the first direction, the first drive structure configured as the first recess can press against the end portion 8 of the pin 42. Preferably, the first recess is configured in a hemispherical profile recessed away from the locking element 4, and the end portion 8 is configured in a hemispherical profile protruding to the second movable element 3. Hence, there is a relatively small resistance when the first recess and the end portion 8 interact with each other. Under a compression of the first drive structure, the pin 42 receives a force, a component force of the compression force, from an axial direction thereof, thereby the pin 42 moves against the spring force of the spring 41 in the axial direction thereof. With the rotation of the second movable element 3, the end portion 8 of the pin 42 completely leaves the first recess, the top of the end portion 8 presses against the second movable element 3, and at least part of the end portion 8 is located in the bore structures of the first movable element 2.

In a case where the second movable element 3 continues to be rotated relative to the stationary element 1, in a state that the pin 42 completely withdraws from the first recess to release the locking of the second movable element 3, the second movable element 3 drives the first movable element 2 via the interaction between the second drive structure 6 configured as the second recess and the driven structure 21, thereby the first movable element 2 also can be rotated relative to the stationary element 1 in the first direction. When the first movable element 2 is rotated, the third drive structure 7 configured as the bore structures continues to press the end portion 8 of the pin 42 by means of a bore edge portion towards the stationary element. The component force of the compression force forms a force applied on the pin 42 along an axial direction of the pin 42. With the force applied on the pin 42 along the axial direction thereof, the pin 42 can again move against the spring force of the spring 41, and subsequently the pin 42 completely withdraws from the bore structure when the pin 42 moves to a particular position, thereby, the locking element 42 releases the locking of the first movable element 2. Accordingly, the first movable element 2, completely unlocked, can be rotated in the first direction relative to the stationary element 1, therefore, the electrical contact bodies arranged on the first movable element 2 are also rotated therewith.

It should be noted herein that although FIG. 2 and FIG. 3 only schematically show the case that the locking element 4 moves relative to one of the plurality of bore structures on the first movable element 2 to show that the locking element 4 unlocks the first movable element 2 and the second movable element 3, according to the connector device 100 of the present invention, the locking element 4 also can move relative to other bore structures in a manner as described above as the second movable element 3 is continuously rotated in the same direction, so as to achieve unlocking of the first movable element 2 and the second movable element 3 by the locking element 4.

Figure 4A:
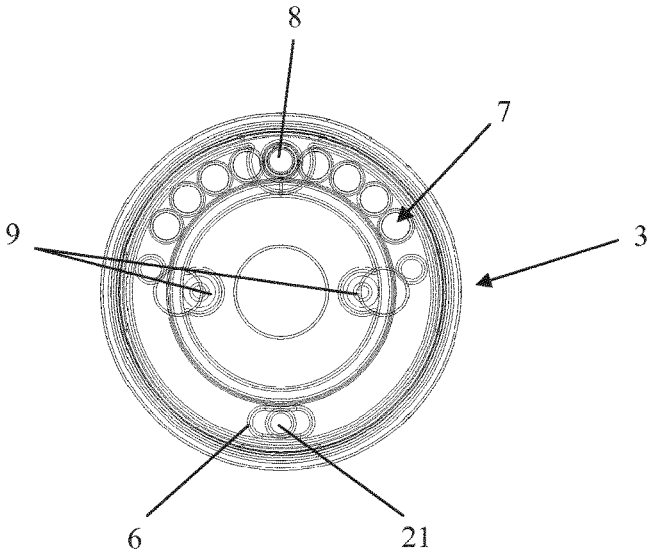
FIGS. 4*a* to 4*c* show top schematic diagrams during a process of successively unlocking the second movable element and the first movable element with the locking element by operating the second movable element in a first direction according to an embodiment of the present invention.
Figure 4B:
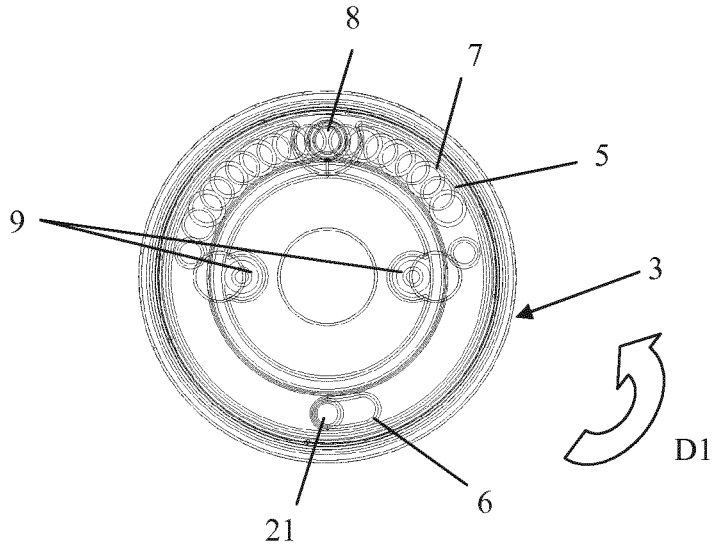
Figure 4C:
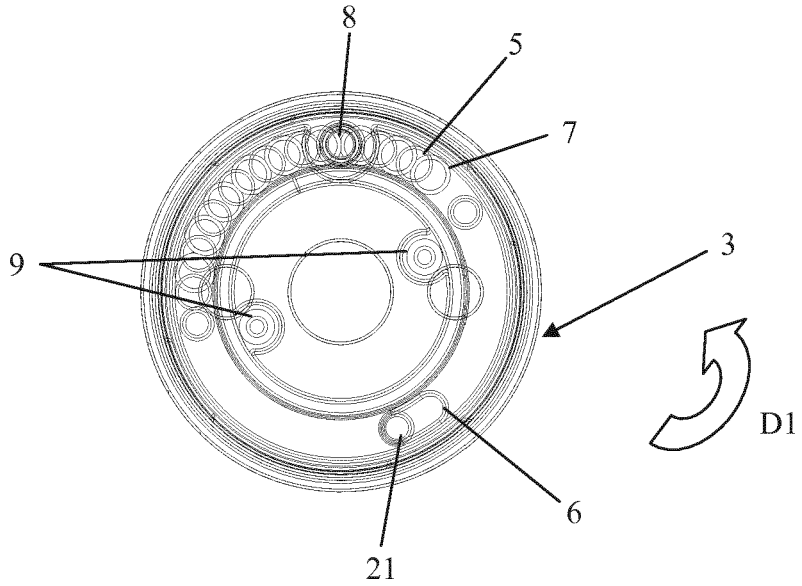

FIGS. 4*a* to 4*c* show top schematic diagrams during a process of successively unlocking the second movable element 3 and the first movable element 2 with the locking element 4 by operating the second movable element 3 in a first direction D1 according to an embodiment of the present invention. FIG. 4*a* shows an initial state of the connector device 100. In this state, the end portion 8 of the pin 42 runs through the bore structure on the first movable element to be received in the first recess of the second movable element. Besides, in the initial state shown, the plurality of bore structures on the first movable element can be positionally corresponding to a plurality of first recesses on the second movable element. Hereby, the driven structure 21 on the first movable element is located in an intermediate position in the second driven structure 6, that is, the driven structure 21 preferably configured as protrusion does not press against both ends of the second recess which is preferably configured in an elliptical shape.

In FIG. 4*b*, due to the rotation of the second movable element 3 in the first direction D1, the first recess on the second movable element 3 is positionally offset from the bore structures on the first movable element, the pin 42 moves in the axial direction, and the driven structure 21 can move to and press against one end of the second recess. Hereby, the electrical contact bodies 9 on the first movable element are not changed relative to the state as shown in FIG. 4*a*. As the second movable element 3 continues to be rotated in the first direction D1, the second movable element 3 drives the first movable element with the help of the driven structure 21 which is already against the second recess, consequently, the first movable element is rotated. Hereby, as can be seen from FIG. 4*c*, the electrical contact bodies 9 change with respect to FIG. 4*a* and FIG. 4*b*, and they are in consistent with the rotating direction the first direction D1.

Figure 5A:
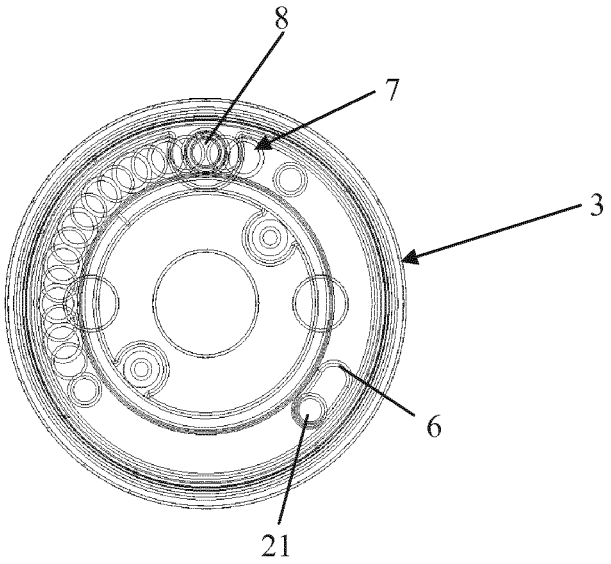
FIGS. 5*a* to 5*b* show top schematic diagrams during a process of locking the first movable element and the second movable element with the locking element by operating the second movable element in a second direction according to an embodiment of the present invention.
Figure 5B:
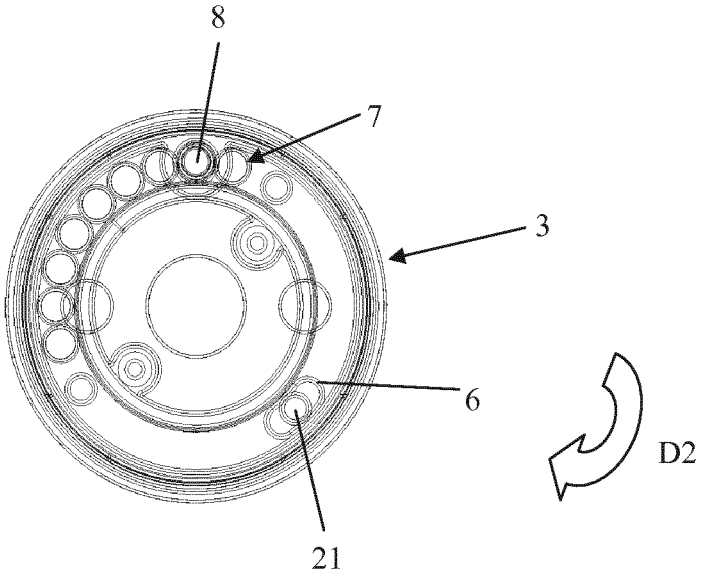

FIGS. 5*a* to 5*b* show top schematic diagrams during a process of locking the first movable element 2 and the second movable element 3 with the locking element 4 by operating the second movable element 3 in a second direction D2 according to an embodiment of the present invention. After the electrical contact bodies 9 have been adjusted to desired locations, the second movable element 3 can be rotated in the second direction D2 opposite to the first direction D1 in order to restore the locking of the first movable element and the second movable element 3. Hence, the end portion 8 of the pin runs through the bore structure on the first movable element, with the help of the resistance of the spring, to return to the first recess of the second movable element 3, whereupon the locking element restores the locking of the first movable element and the second movable element. Besides, the driven structure 21 also moves with respect to the second recess from one end of the second recess according to the rotation of the second movable element 3 and back to an intermediate position of the second recess.

It should be noted herein that the first direction and the second direction shown and described in the embodiments are merely illustrative, and in a specific operation, according to the connector device of the present invention, an operator also can exchange the first direction and the second direction to achieve desired functions to be achieved by the present invention.

The above is merely preferred embodiments of the present invention but not to limit the present invention. For the person skilled in the art, the present invention may have various alterations and changes. Any alterations, equivalent substitutions, improvements, within the spirit and principle of the present invention, should be covered in the protection scope of the present invention.

LIST OF REFERENCE SIGNS

1 stationary element
2 first movable element
3 second movable element
4 locking element
5 first drive structure
6 second drive structure
7 third drive structure
8 end portion
9 electrical contact body
11 cavity
21 driven structure
41 spring
42 pin
100 connector device
D1 first direction
D2 second direction

The invention claimed is:

1. A connector device for an illumination apparatus, comprising a stationary element for connecting to the illumination apparatus, a first movable element for connecting to a power supply, a second movable element rotatably connected to the stationary element, and a locking element arranged between the stationary element and the second movable element, characterized in that rotation of the second movable element in a first direction drives the locking element to release locking of the second movable element, and when the second movable element continues to be rotated in the first direction and drives the first movable element to rotate together, rotation of the first movable element enables the locking element to release locking of the first movable element.

2. The connector device according to claim 1, characterized in that at least one first drive structure and a second drive structure are arranged on a surface of the second movable element facing the stationary element, wherein the second movable element, with the interaction between the first drive structure and the locking element, enables the locking element to move and release locking of the second movable element, and the second movable element, with the interaction between the second drive structure and the first movable element, drives the first movable element to rotate together.

3. The connector device according to claim 2, characterized in that the first drive structure, with an axial component force generated on the locking element when the second movable element is rotated, enables the locking element to move axially to release locking of the second movable element.

4. The connector device according to claim 2, characterized in that the locking element locks the second movable element when the locking element is received in the first drive structure.

5. The connector device according to claim 2, characterized in that a driven structure, arranged on a surface of the first movable element facing the second movable element, is connected with the second drive structure in a form-fitted manner.

6. The connector device according to claim 1, characterized in that when the second movable element is rotated in a second direction opposite to the first direction, rotation of the second movable element in the second direction is capable of restoring the locking of the first movable element and the second movable element by the locking element.

7. The connector device according to claim 1, characterized in that the first movable element comprises at least one third drive structure, when the second movable element continues to be rotated in the first direction and drives the first movable element to rotate together, the first movable element, with the interaction between the third drive structure and the locking element, enables the locking element to continue to move and release the locking of the first movable element by the locking element.

8. The connector device according to claim 7, characterized in that the third drive structure, with an axial component force generated on the locking element when the first movable element is rotated, enables the locking element to move axially to release locking of the first movable element.

9. The connector device according to claim 7, characterized in that the third drive structure is configured as a bore structure, through which bore structure the locking element extends and is received in the first drive structure to lock the first movable element and the second movable element.

10. The connector device according to claim 9, characterized in that the bore structure is arranged at an edge of the first movable element at least along a circumference of the first movable element.

11. The connector device according to claim 9, characterized in that an edge portion of the bore structure towards the stationary element is configured to be rounded.

12. The connector device according to claim 2, characterized in that the first drive structure is configured as a first recess, and the second drive structure is configured as a second recess.

13. The connector device according to claim 12, characterized in that the first recess is configured in a hemispherical profile, and the second recess is configured in an elliptical profile.

14. The connector device according to claim 1, characterized in that the locking element is configured as a cylindrical structure having elastic resilience, and when the second movable element is rotated in a second direction opposite to the first direction, the locking element is capable of automatically restoring the locking of the first movable element and the second movable element with the resilience.

15. The connector device according to claim 14, characterized in that the locking element comprises a spring and a pin, when the second movable element is rotated in the second direction, the pin is capable of automatically restoring the locking of the first movable element and the second movable element with the spring.

16. The connector device according to claim 14, characterized in that an end portion of the locking element capable of interacting with the first drive structure and the second drive structure is configured in a hemispherical shape.

17. An illumination apparatus, comprising the connector device according to claim 1 and a light engine.

* * * * *